US010439344B1

(12) United States Patent
Harden

(10) Patent No.: US 10,439,344 B1
(45) Date of Patent: Oct. 8, 2019

(54) UNIVERSAL DC POWER SUPPLY EXTENSION CABLE SYSTEM

(71) Applicant: BBY SOLUTIONS, INC., Richfield, MN (US)

(72) Inventor: Kenneth Harden, Eden Prairie, MN (US)

(73) Assignee: BBY SOLUTIONS, INC., Richfield, MN (US)

( * ) Notice: Subject to any disclaimer, the term of this patent is extended or adjusted under 35 U.S.C. 154(b) by 0 days.

(21) Appl. No.: 16/050,054

(22) Filed: Jul. 31, 2018

(51) Int. Cl.
*H01R 31/06* (2006.01)
*H01R 24/20* (2011.01)
*H01R 27/00* (2006.01)

(52) U.S. Cl.
CPC ..... *H01R 31/06* (2013.01); *H01R 24/20* (2013.01); *H01R 27/00* (2013.01)

(58) Field of Classification Search
CPC ..... H01R 31/00; H01R 31/06; H01R 24/00; H01R 24/20; H01R 24/38; H01R 27/00; H01R 27/02; H02M 3/00
See application file for complete search history.

(56) References Cited

U.S. PATENT DOCUMENTS 6,894,457 B2 * 5/2005 Germagian ..... H02J 7/0042 320/119
7,183,743 B2 * 2/2007 Geiger ..... B60R 11/02 320/111
7,422,473 B2 * 9/2008 Portwood ..... H01R 27/00 363/144
7,605,594 B2 * 10/2009 Blades ..... G01R 31/041 324/424
7,874,844 B1 * 1/2011 Fitts, Jr. ..... H01R 31/06 439/218
7,926,662 B2 * 4/2011 Ouimette ..... B65D 75/367 206/463
8,894,419 B1 * 11/2014 Buelow ..... H01R 13/6205 439/218
9,184,546 B2 11/2015 Fleisig
2005/0136745 A1 * 6/2005 Li ..... H01R 13/6272 439/638
2012/0081067 A1 4/2012 Burrell, IV

* cited by examiner

*Primary Examiner* — Vanessa Girardi
(74) *Attorney, Agent, or Firm* — Tysver Beck Evans

(57) ABSTRACT

A DC power supply extension cable system includes a cord, a plurality of first barrel connectors and a plurality of second barrel connectors. The cord has a first end and a second end. The first end defines a first interface configured for the engagement of one of any of the first barrel connectors, and the second end likewise defines a second interface configured for the engagement of one of any of the second barrel connectors. The first interface is different than the second interface. Each of the first barrel connectors has a receiving opening therein and a first engagement mechanism configured to be accepted by only the first interface. Whereas each of the second barrel connectors has an external plug extending therefrom, and a second engagement mechanism configured to be accepted by only the second interface.

11 Claims, 11 Drawing Sheets

UNIVERSAL DC POWER SUPPLY EXTENSION CABLE SYSTEM

FIELD OF THE INVENTION

Embodiments of the disclosure described herein are directed to the field of electrical power cords and adapters for transmitting electrical power from a DC power supply and transmitting that power to any of a variety of receiving devices. More specifically, embodiments described herein, are directed to a universal plug adapter system comprised of a cord or cable having a variety of specialized male and female adapter plugs that allow the cord to be used with any type of DC power supply and any type of electrical appliance requiring DC power supplied thereto.

SUMMARY

DC power supplies are ubiquitous throughout the world and are used to supply power to a variety of electronic devices both large and small. From portable electronics such as cellular phones, e-readers and personal computing devices to lap top computers and small appliances DC power supplies are an essential component to many electronic devices. There are numerous limitations to the use and convenience of such DC power supplies however, particularly when a user is forced to use several of these fairly bulky components to supply power to a variety of electronic devices.

From restrictive cord length limiting their ease of use in a given location, to the fact that many DC power supplies are manufactured with specific plug ends so that only a single type of device may be used with a given power supply; DC power supplies are well recognized as being cumbersome, bulky and necessarily duplicative if a user wants to ensure that all of their devices has adequate and appropriate power for their individual use.

In an effort to alleviate some of the more limiting aspects of known DC power supply models, simple add-ons or extraneous devices such as AC extension cords are typically used to extend the cord length of the power supply. Such AC end extension cords however include a bulky female AC receiver block for receipt of the "male" AC plug of the power supply, in order to link the AC end of the power supply to the wall outlet, resulting in not only the bulk of the DC power supply extending some distance across a room but also adding to it, the receiver block/plug of the AC end of the extension cord being present as well. As many a user of such cords will undoubtedly be familiar, such extension cords are bulky, potentially a hazard to those that are forced to traverse their presence and bulk, and frankly contrary to the aesthetics of nearly any room in which they are utilized.

It is therefore a desire to provide a DC power supply with a mechanism that allows the power supply to have a longer cord reach without the added bulk of the conventional AC end to outlet extension cord. Embodiments of this disclosure meet this criteria by providing a DC extension cord which maintains a low profile even at interfaces of the extension cord with both the device to be powered and the male end of the cord extending from the DC power supply. In some embodiments, the DC extension cord is made "universal" by providing one or both ends of the extension cord with a variety of adapters that when properly utilized allow a single cord to be used with nearly any type of DC power supply and/or device to be powered.

BRIEF DESCRIPTION OF THE DRAWINGS

PRIOR ART

PRIOR ART

DETAILED DESCRIPTION

Figure 1:
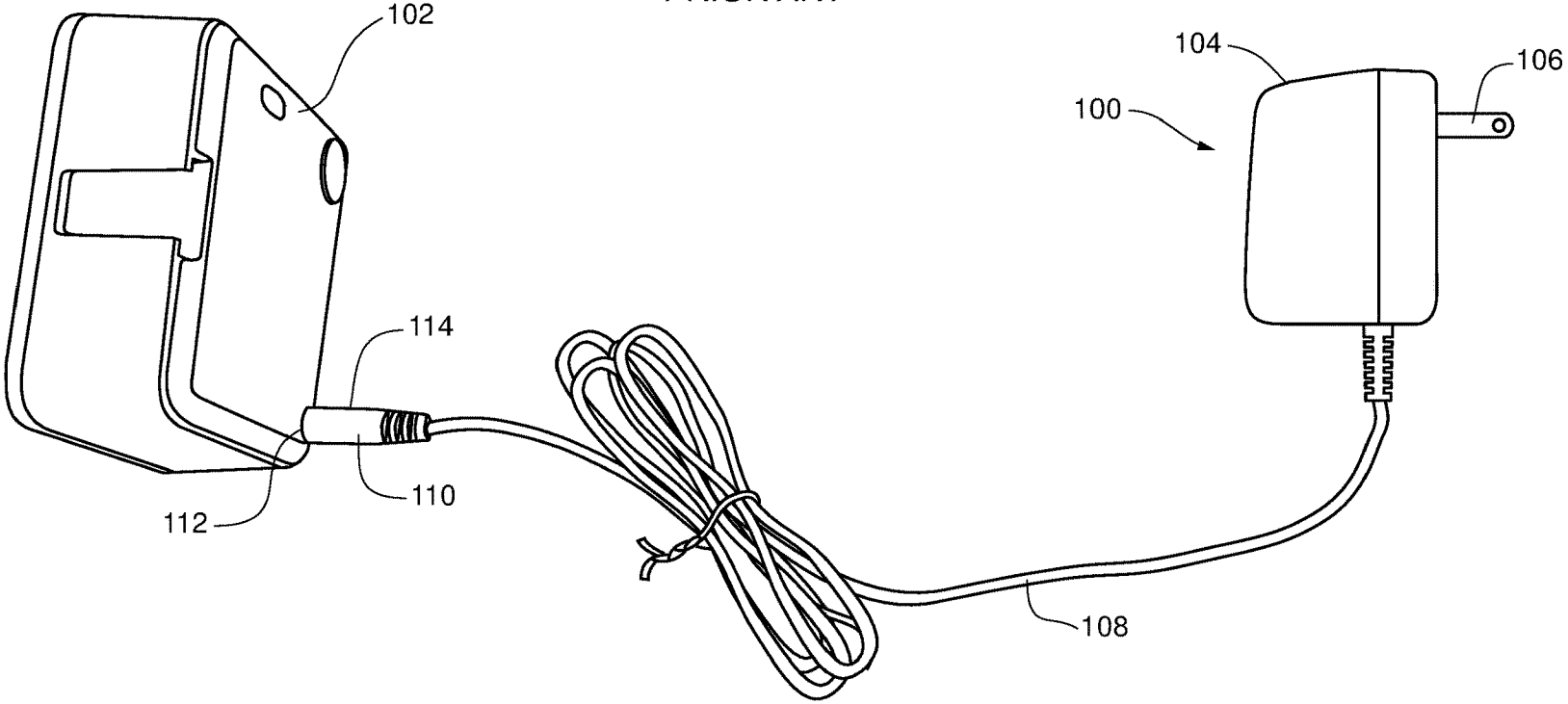
FIG. 1 PRIOR ART
FIG. 1 is an image of a known DC power supply and an electronic device for which it is intended to provide power.

With their bulky converter housing, be they located at the wall plug or in the middle of a cord (such as is often the case with computer DC power supplies) assembly, DC power supplies are easily recognized as a ubiquitous accessory common to all users of modern small electronic devices. An example of a typical DC power supply 100 and small appliance 102, which it is designed to power, is illustrated in PRIOR ART FIG. 1.

As is shown, the DC power supply 100 includes a transformer housing or 'brick' 104 with a conventional two or three prong AC plug 106 for engaging a wall outlet (not shown). Extending from the brick 104 is the power cord 108 for conducting DC electricity to the device 102. The cord 108 terminates at a DC terminal connector 110 that plugs into a DC receiver port 112 on the device 102. The DC terminal connector 110 is typically a cylindrical projection that extends from the larger diameter insulated grip portion 114 of the connector 110 for receipt into and by the port 112. When the DC terminal connector is plugged into the port 112, and AC power is supplied to the power supply 100, DC power is supplied to the device 102 via the brick 104, cord 108 and terminal connector 110 in the conventional manner.

Figure 2:
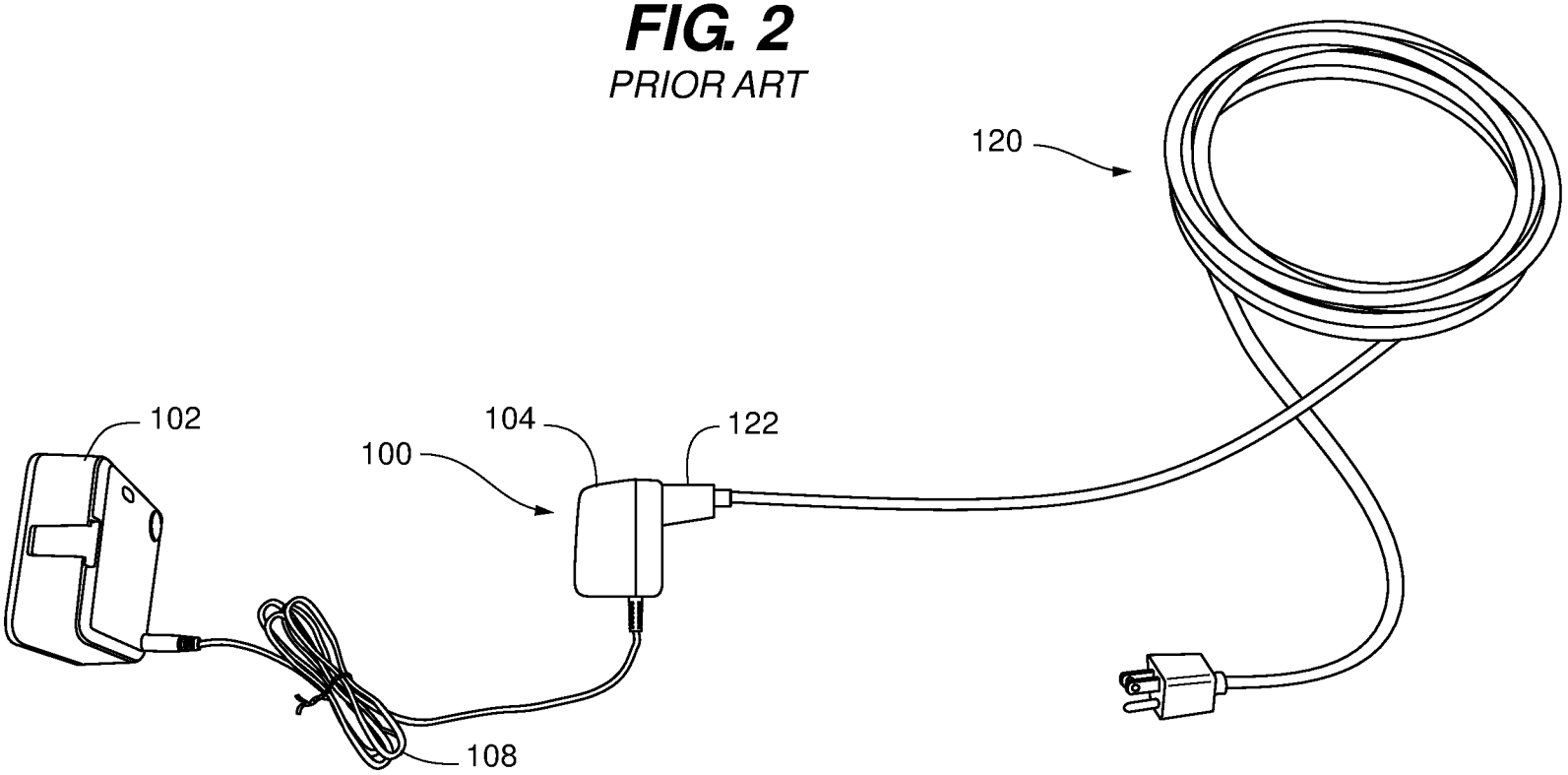
FIG. 2 PRIOR ART
FIG. 2 is an illustration of the DC power supply and electronic device of PRIOR ART FIG. 1 with a female end of a conventional AC extension cord connected to the wall plug end of the DC power supply.

As mentioned above, known shortcomings of DC power supplies of the type shown in PRIOR ART FIG. 1 is the relative bulk of the brick 104 and the limited length of the cord 108. When a conventional AC extension cord 120 of the type shown in PRIOR ART FIG. 2 is used to address the latter issue, the added bulk of the extension cord's female end (plug receiving end) 122, tends to exacerbate the former issue. The use of an AC extension cord 120 acts to reposition the bulk and weight of the brick 104 away from a point immediately adjacent to a wall outlet, and place it some distance away; often laying out in the open along a wall or even in the middle of a room. The cord 108 and/or cord 120, as well as the brick 104 dislocated in this manner may present a hazard to foot traffic and potentially to the safety of those having to traverse the adjacent area and even to the device 102, in the event that the cords 108/120 or brick 104 are tripped on.

A solution to these shortcomings as disclosed herein is to provide a DC power supply extension cable system 10 of the type shown in FIGS. 3-6 that is configured to extend between the DC terminal connector 110 of the DC power supply 100 to the electronic device 102 rather than between the wall outlet and the plug 106. Such a cord will allow the bulk of the brick 104 to remain secure against a wall and provide a relatively thin, and low profile cable that is able to interface with a wide variety of electronic devices 102.

Figure 3:
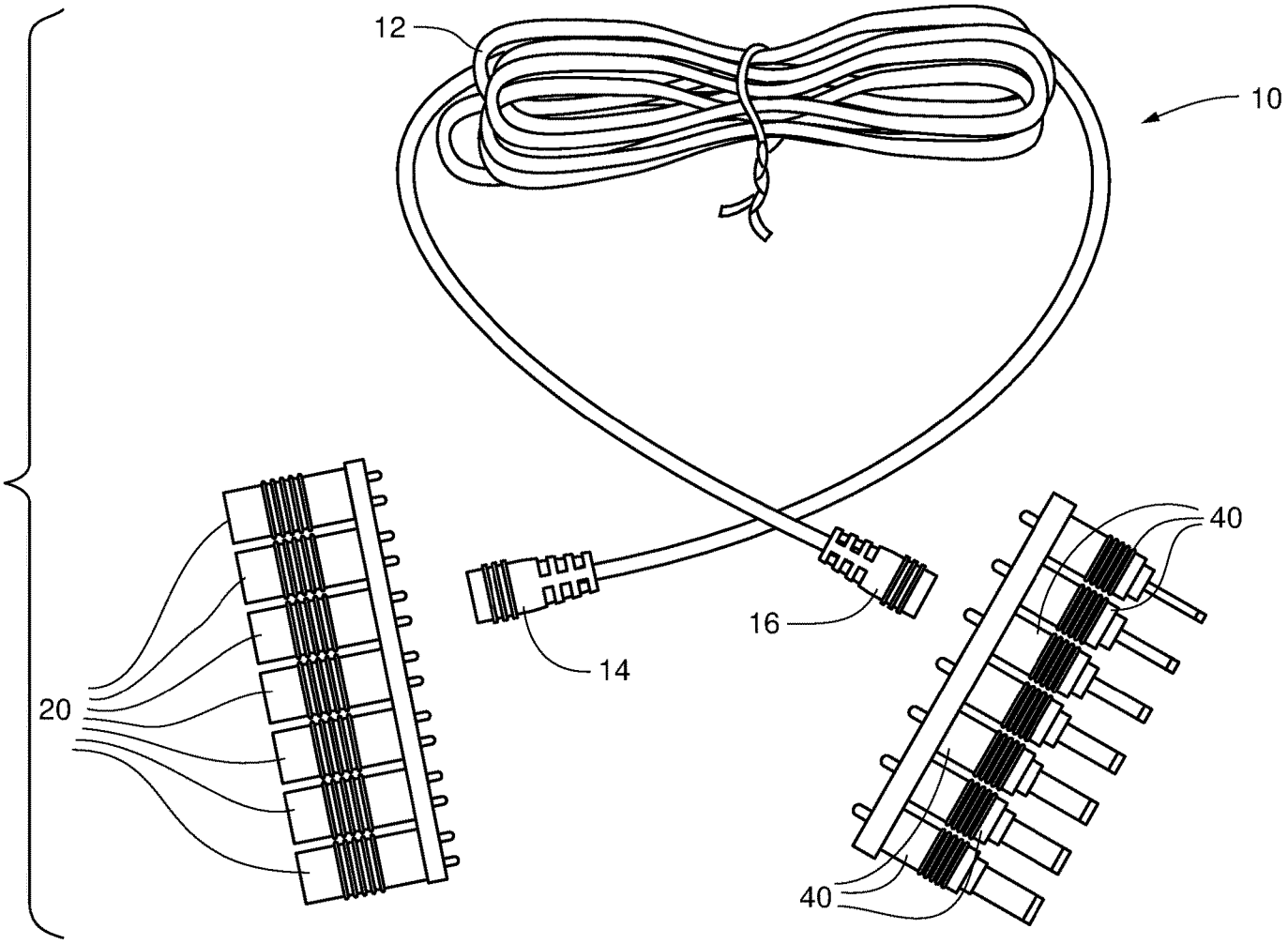
FIG. 3 is a top down view of an embodiment of a universal DC extension cable and a selection of two types of barrel connector adaptors of which are configured for engagement on a respective end of the cord.

As may be seen in FIG. 3, the DC power supply extension cable system 10 comprises an electrical cord (or cable) 12 of any desired length, with ends (female) 14 and (male) 16, of which a first or power supply end 14 is configured for engagement to a first type of barrel connector 20; and a second or appliance or device end 16 for engagement to a second type of barrel connector 40. The first and second types of barrel connectors 20 and 40 and corresponding cable ends 14 and 16 to which they are configured to be engaged or plugged into, are configured such that only the first type of barrel connector 20 will engage the first end 14 of the cord 12, and only the second type of barrel connector 40 will engage the second end 16 of the cord 12. This ensures that there can be no accidental reversal of the proper plugging in of the cable 12 into an electronic device and power supply.

While in some embodiments the ends 14 and 16 are different to ensure that barrel connectors 20 and 40 are not accidentally inserted into the wrong interface, in other embodiments the ends 14 and 16 as well as barrel connectors 20 and 40 are configured to be freely interchangeable so that the direction of tips might be reversed and/or for other applications as well.

In order to ensure that the cable system 10 may be utilized with a wide variety of electrical devices, as well as a variety of different types of DC power supplies, the barrel connectors 20 and 40 are provided in a range of different configurations adapted for receipt or engagement by most, if not all, commonly known types of DC powered devices and supplies. In the embodiment shown in FIG. 3 for example, the cable system 10 is provided with a plurality of up to seven or more different configurations of first barrel connector 20, each of which may have a different size or configuration of opening (female end) 22 (shown in FIG. 9) for receipt of different sized DC power cord plugs 113 (shown in FIG. 4); and a plurality of up to seven or more different configurations of second barrel connector 40, each of which may have a different size/shape/configuration of external plugs (male end) 42 so as to be able to be plugged into a variety of different sizes/configurations of receiver port 112 that a variety of electronic devices 102 might have.

In some embodiments, as an alternative for use in only direct current applications, the connectors 20 and 40 may be configured for use in audio/video applications with one or both connectors having tips adapted for use in RCA 3.5 mm 6.3 mm and other types of jacks/inputs/outputs. Likewise, in some embodiments the connectors are configured with tips and interfaces suitable for use in USB charging and data transmission.

Figure 4:
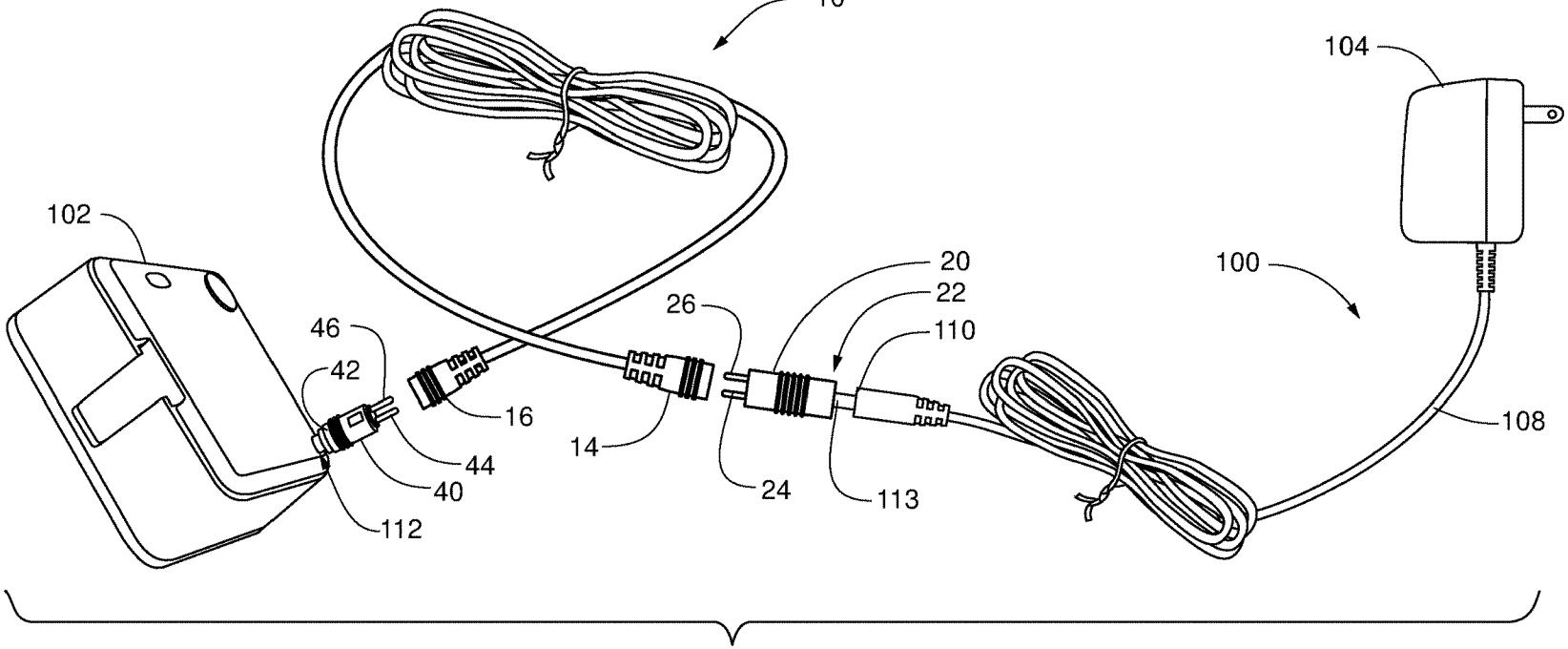
FIG. 4 is a top down component view of the extension cable of FIG. 3 shown in use with the DC power supply and electronic device of PRIOR ART FIG. 1.
Figure 5:
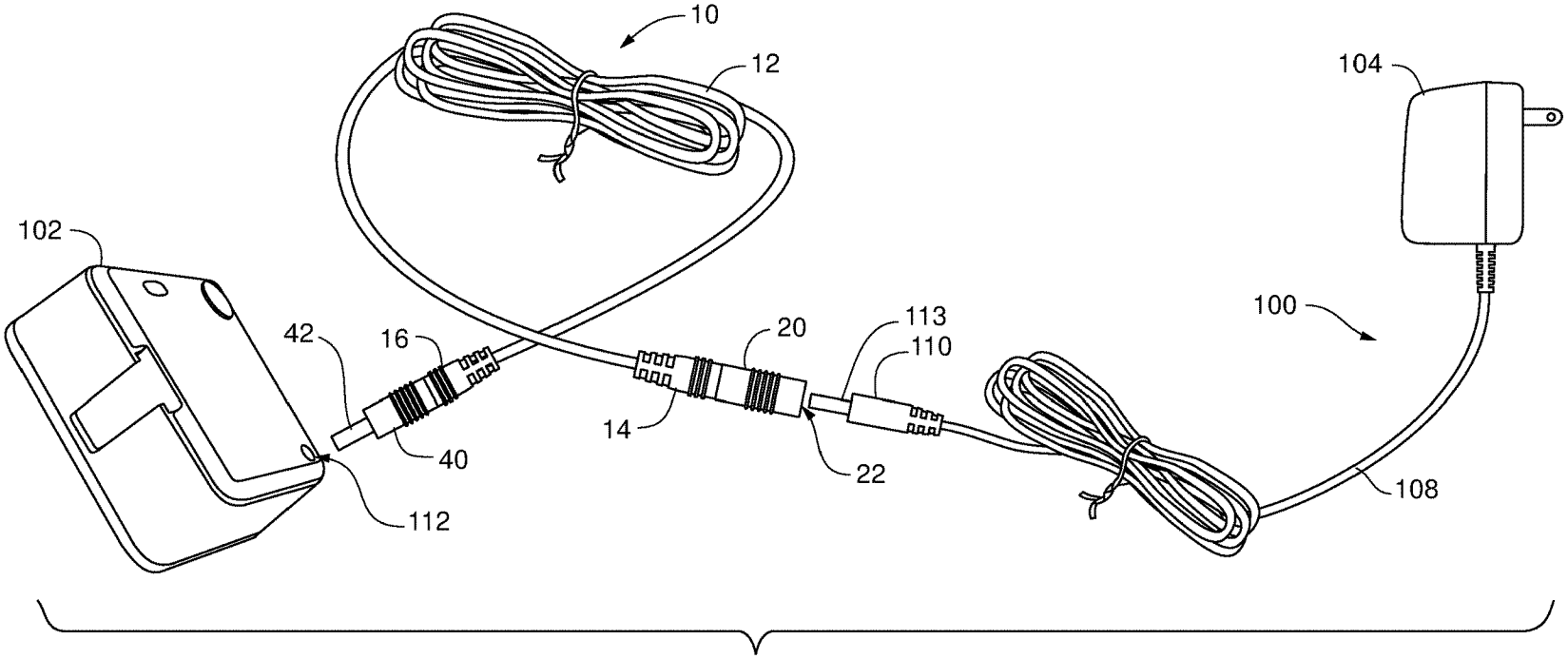
FIG. 5 is a top down view of the extension cable, DC power supply and electronic device of FIG. 4, wherein the cable is fully assembled and ready to be plugged into the electronic device and DC power supply.
Figure 6:
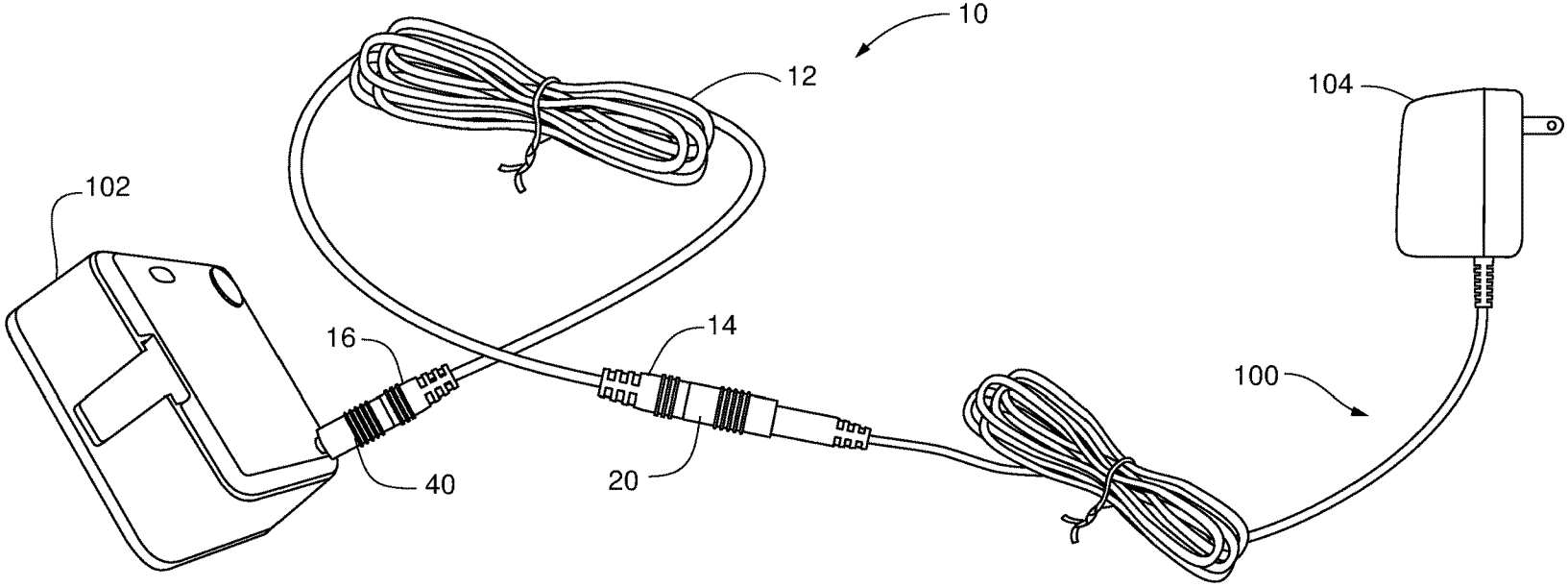
FIG. 6 is a top down view of the extension cable, DC power supply and electronic device of FIGS. 4-5 wherein the cable is fully assembled and plugged into the electronic device and DC power supply.

Turning to FIGS. 4-6, an example of the assembly and use of the cord 10 may be seen in conjunction with a known electronic device 102 and its DC power supply 100. Looking first to FIG. 4, here it shown how one of the plurality of first barrel connectors 20 is selected through estimation and the process of elimination of matching the caliber of the terminal connector plug 113 of the DC power supply 100 to that of the appropriately sized receiving opening 22 (shown in FIG. 9) of one of the plurality of barrel connectors shown in FIG. 3. When the appropriately sized first barrel connector 20 is determined, the plug 113 may be inserted therein. Similarly, at the electronic device end 16 of the cord 12, an appropriately sized plug 42 of the plurality of second barrel connectors 40 is matched to the appropriate sized port 112 of the electronic appliance 102 in order to select the correct second barrel connector 40 for use therewith.

As has been mentioned, each of the barrel connectors 20 and 40 are provided with a mechanism that ensures that only first barrel connectors 20 are capable of engaging the first end 14 of the cord 12 and only second barrel connectors 40 are capable of engaging the second end 16 of the cord 12. On a most basic level the barrel connectors 20 and 40 may be coordinated to share color, texture and shape with their corresponding end 14 and 16 of the cord 12. But the present embodiments go further to ensure that it is impossible to erroneously plug the wrong barrel connector into the wrong end of the cord.

Figure 7:
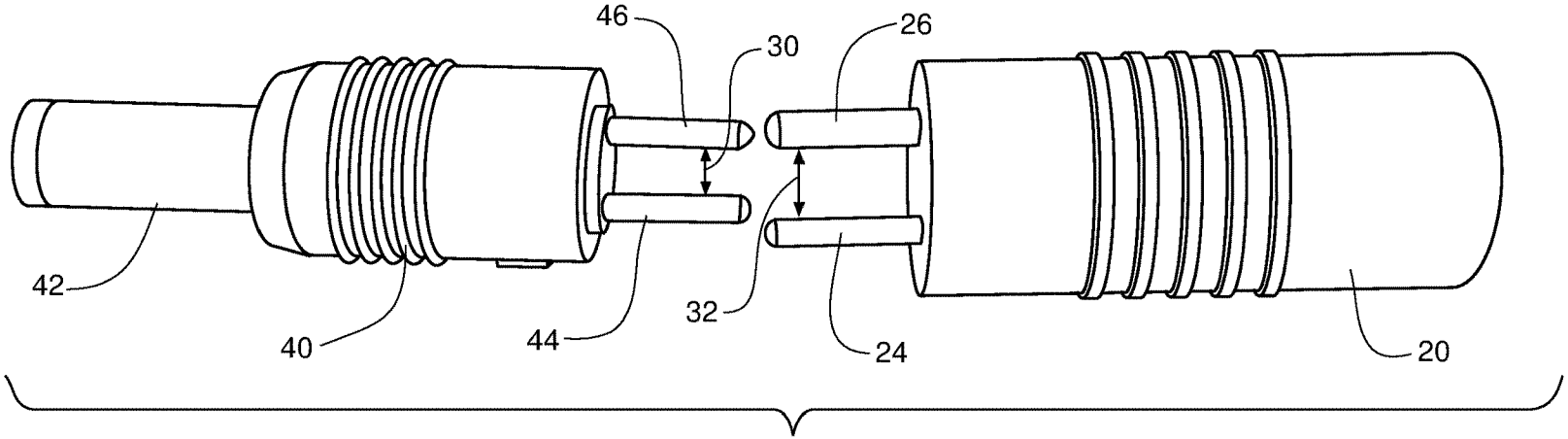
FIG. 7 is a close up side-by-side view of the two types of barrel connectors that are used at the respective ends of the DC extension cable shown in FIGS. 3-6.

An example of this mechanism is shown in FIG. 4, wherein each of the first barrel connectors 20 are provided with an engagement mechanism, in this instance a pair of parallel and outwardly extending prongs sized and arranged to interface only with the first end 14 of the cord. In the embodiment shown, the prongs (first) 24 and (second) 26 are distinct from one another in that one prong 24 is narrower or smaller than prong 26. Each of the second barrel connectors 40 are provided with a similar engagement mechanism, for unique engagement to the second end 16 of the cord, such as in the embodiment shown, simply by providing second barrel connectors 40 with prongs (third) 44 and (fourth) 46 of the same size/shape/diameter (within manufacturing tolerances), but with different spacing (represented by arrows 30 in FIG. 7) between the prongs 44 and 46 than the spacing (represented by arrows 32 in FIG. 7) between prongs 24 and 26. While this difference in barrel connector to cord interface mechanisms is visible in the assemblage of FIG. 4 a more detailed view is provided in FIG. 7.

When proper size and configurations of the respective barrel connectors 20 and 40 have been determined, and selected, the cable system 10 may be fully assembled such as in the manner shown in FIG. 5, by engaging the selected first barrel connector 20 to the first end of the cord 12, and likewise connecting the second barrel connector 40 to the second end 16 of the cord. Plug 113 of the DC power cord 100 is plugged into the receiver opening 22 of the first barrel connector 20, and the plug 42 of the second barrel connector 40 is plugged into the receiver port 112 of the electronic device 102, thereby providing a stream-lined, low profile DC extension cable assembly such as is shown in FIG. 6.

Figure 8A:
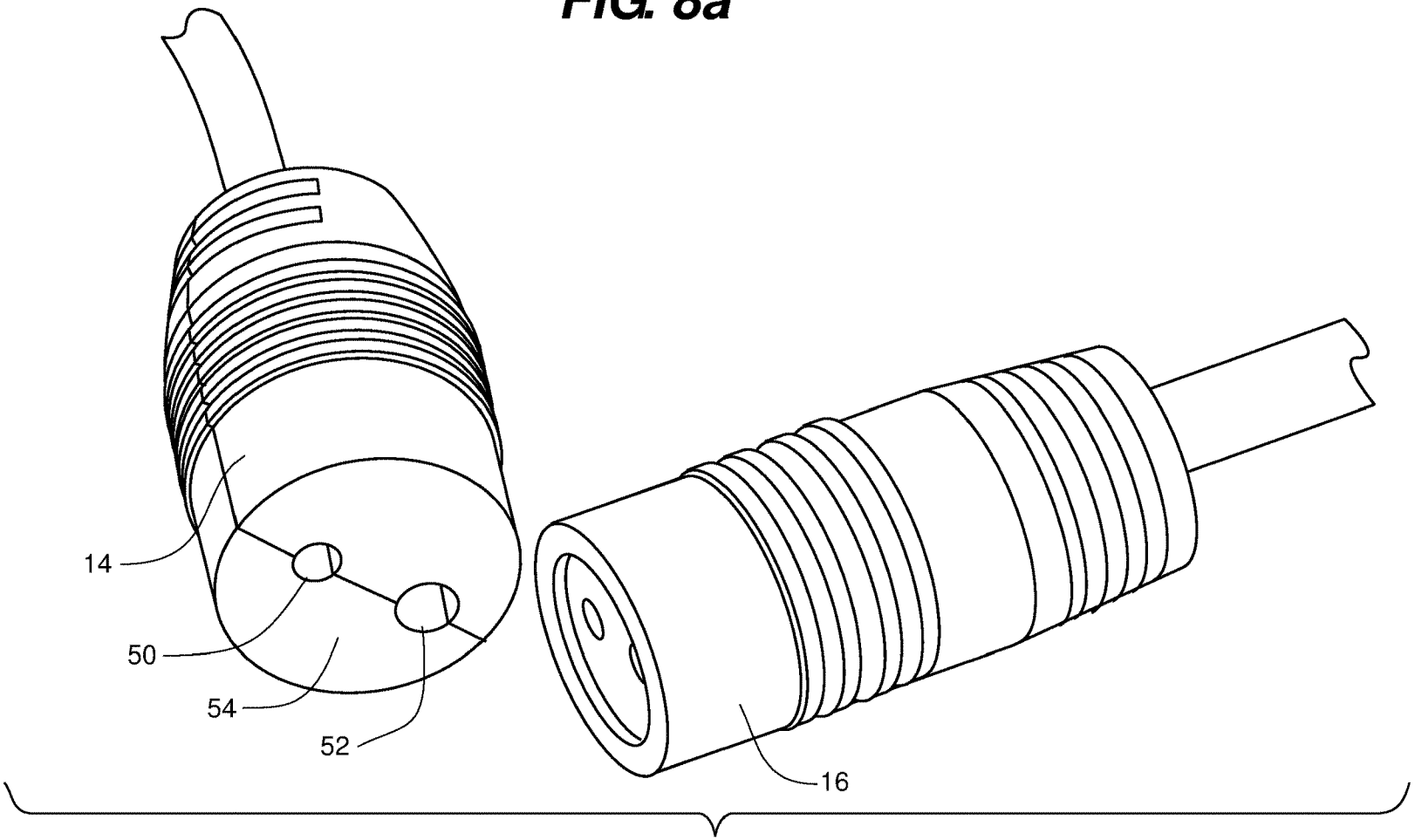
FIGS. 8*a* and 8*b* are close up side by side views of each end of the universal DC extension cable shown in FIGS. 3-6 with their receiver ports for receipt of the barrel connectors shown in FIG. 7 more clearly depicted.
Figure 8B:
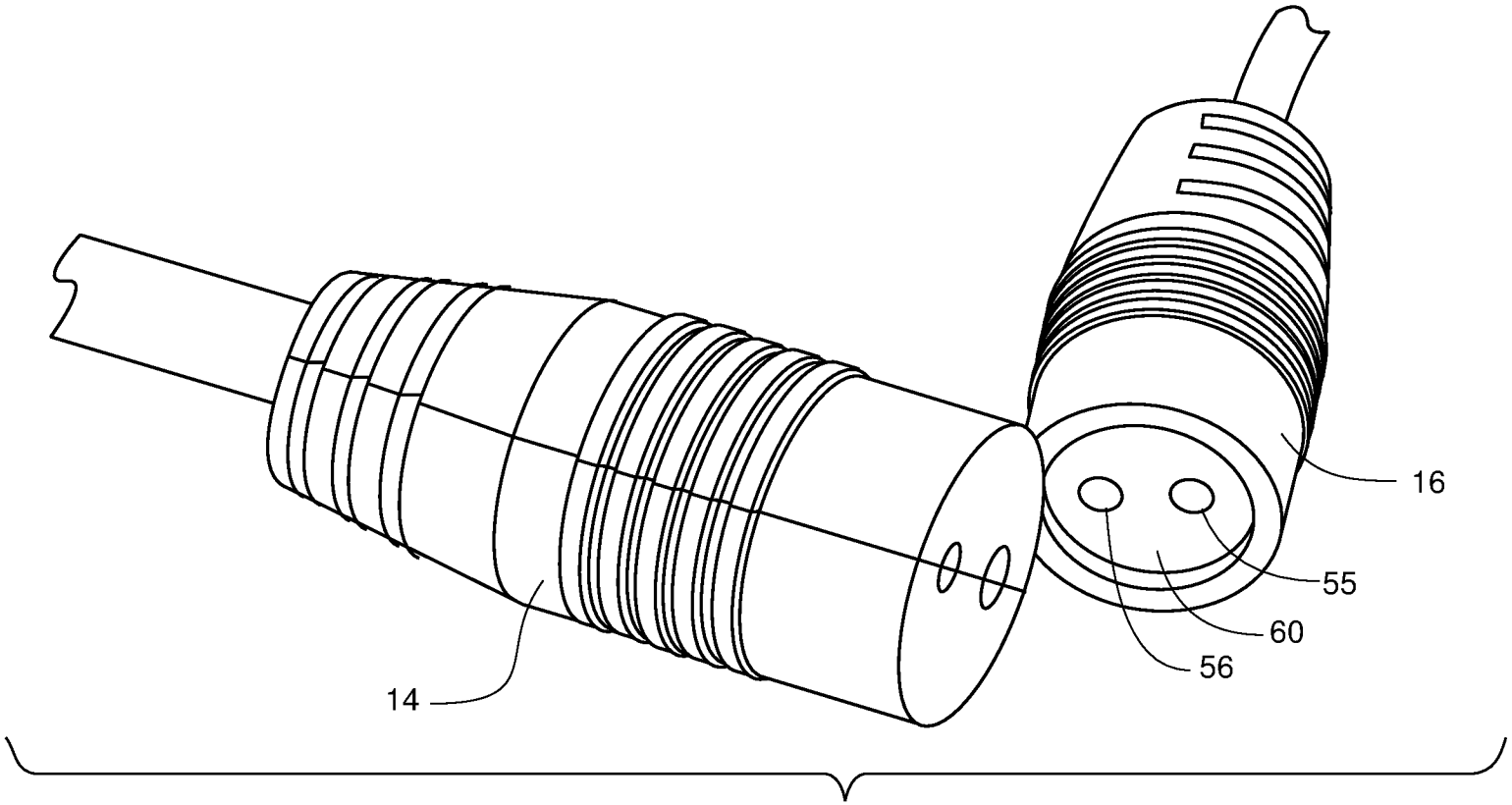

Turning now to FIGS. 8*a* and 8*b* wherein the ends 14 and 16 of the cord 12 are shown in detailed comparison so as to better illustrate how each of the ends 14 and 16 provides a unique engagement mechanism that ensures only the appropriately sized and spaced prongs of the plurality of first barrel connectors 20 and second barrel connectors 40, respectively, may be engaged.

In FIG. 8*a*, the first end 14 is shown having two openings 50 and 52, of which first opening 50 is sized and shaped to receive prong 24 and second opening 52 is larger in diameter/size and thus sized to accommodate receipt of prong 26. The openings are spaced a distance (represented by arrows 54) which corresponds to the distance 32 between the prongs 24 and 26 of each of the plurality of first barrel connectors 20. In FIG. 8*b*, the second end 16 of the cord 12 is show such that the openings for receipt of prongs 44 and 46 are visible. As shown, the openings (third) 56 and (fourth) 58 defined by the second end 16 are of the same size/diameter and shape corresponding to the size/diameter and shape of prongs 44 and 46. The openings 56 and 58 are spaced apart a distance (represented by arrows 60) which correspond to distance 30 between the prongs 44 and 46 of each of the plurality of second barrel connectors 40. The distances 54 and 60 are thus different from one another in the same way as distances 30 and 32 are different from one another as mentioned above.

Figure 9:
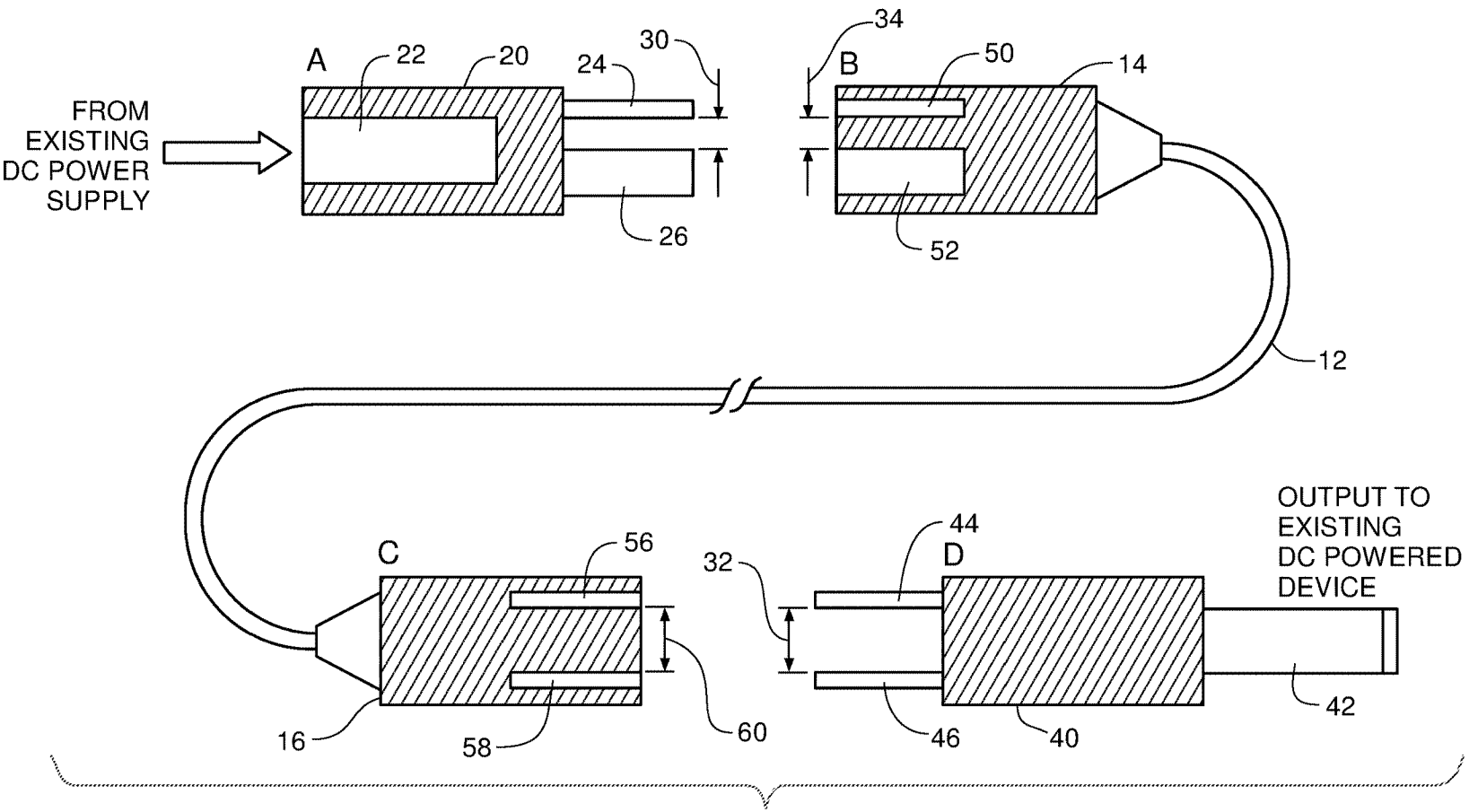
FIG. 9 is a diagrammatic sectional view illustrating the manner in which the barrel connectors shown in FIG. 7 are coupled to their respective receiver ports (shown in FIGS. 8*a* and 8*b*) to form the universal DC extension cable shown in FIGS. 4 and 5.

Turning now to FIG. 9 where a diagrammatic sectional view of the embodiment of the cable system 10 discussed above is shown in its component parts with the size and shape relationships of prongs to openings, as well as their respective spacings illustrated.

Figure 10:
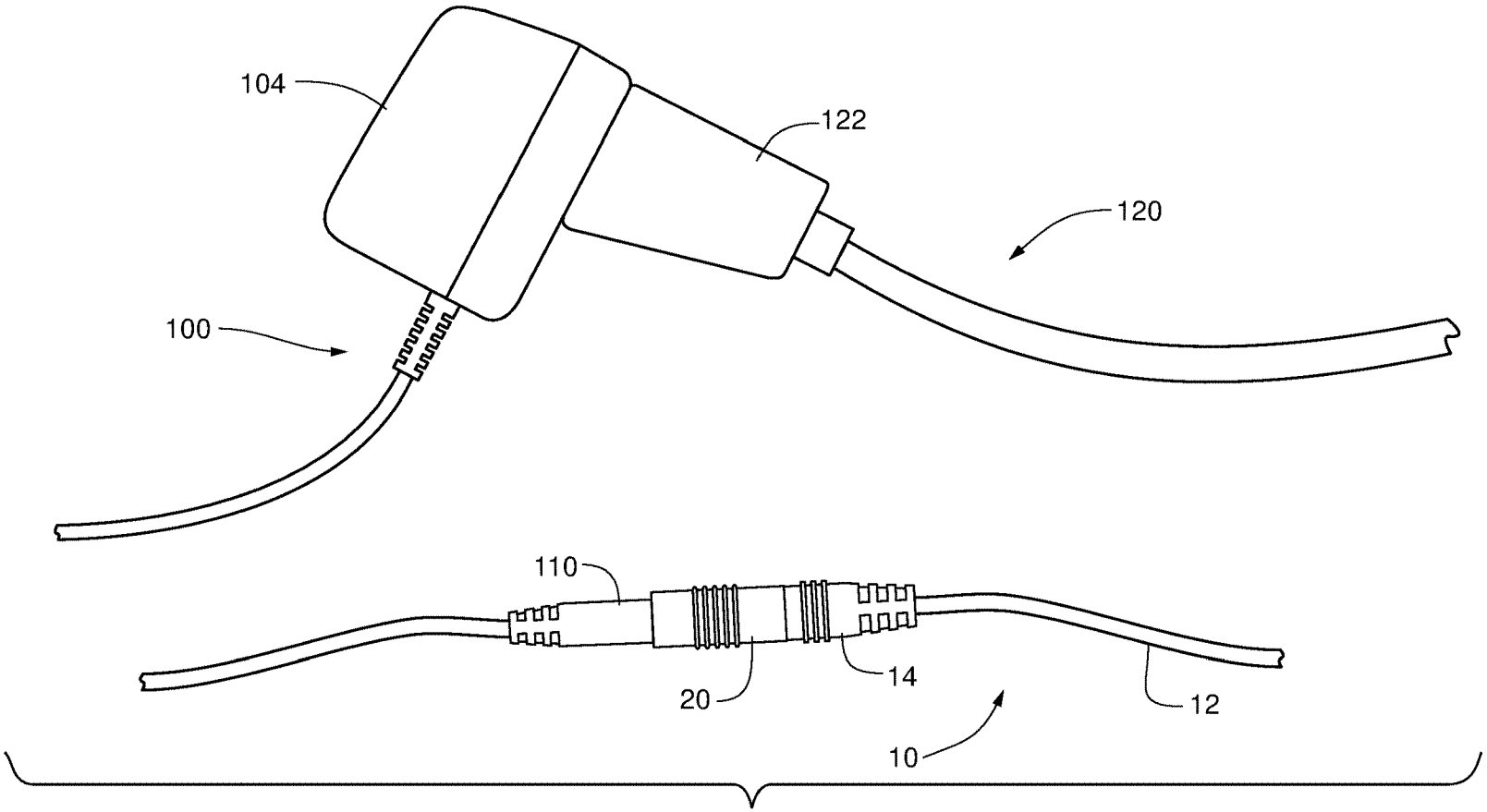
FIG. 10 is a close-up view of the interface of the DC power supply and extension cable of FIGS. 5-6 shown in comparison to the interface of a DC power supply and conventional AC extension cord shown in PRIOR ART FIG. 2.

Finally, turning to FIG. 10. Here we see shown for comparison of relative profile, the previously mentioned junction of a typical AC extension cord 120 that might be used to connect to and extend the reach of a DC power cord 100 but at the cost of the repositioning the combined bulk of the extension cord plug 122 and the brick 104. Compare this excessive mass, to that of the fairly linear, low profile connection junction afforded by plugging in the terminal end 110 of the DC power cord 100 into the relatively slim first barrel connector 20 and its associated first end of the cord 12, provided by the universal DC power supply extension cable system 10 disclosed herein. The ergonomic and safety benefits of such a cable system 10 compared to the use of a traditional AC extension cord are made readily apparent by this comparison.

It should be apparent to anyone of ordinary skill in the art that the cable system 10 and its associated components as shown and described herein are electrically conductive of direct electrical current in a suitable and safe manner appropriate for use with any of a variety of electrical devices capable of receiving DC power from a DC power source.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A DC power supply extension cable system comprises:
a cord, a plurality of first barrel connectors and a plurality of second barrel connectors
the cord having a first end and a second end, the first end defining a first interface configured for the engagement of one of any of the plurality of first barrel connectors, the second end defining a second interface configured for the engagement of one of any of the plurality of second barrel connectors, the first interface being different than the second interface;
each of the plurality of first barrel connectors defining a receiving opening therein and a first engagement mechanism configured to be accepted by only the first interface,
each of the plurality of second barrel connectors having an external plug extending therefrom and a second engagement mechanism configured to be accepted by only the second interface.

2. The system of claim 1, wherein the plurality of first barrel connectors comprises seven barrel connectors.

3. The system of claim 1 wherein the receiving opening of each of the plurality of first barrel connectors has a different configuration.

4. The system of claim 1, wherein the plurality of second barrel connectors comprises seven barrel connectors.

5. The system of claim 1 wherein the external plug of each of the plurality of second barrel connectors has a different configuration.

6. The system of claim 1, wherein the first interface consists of a first opening and a second opening defined by the first end of the cord, the second opening having a different size than the first opening, the first opening and the second opening being spaced a first distance apart.

7. The system of claim 6, wherein the first engagement mechanism is a pair of parallel extending prongs, the prongs being a first prong and a second prong, the second prong having a size greater than that of the first prong, the first prong and the second prong being spaced a distance apart from one another that is the same as the first distance.

8. The system if claim 7, wherein one of the plurality of first barrel connectors is couple to the first end of the cord by plugging the first prong into the first opening and the second prong into the second opening.

9. The system of claim 7, wherein the second interface consists of a third opening and a fourth opening defined by the second end of cord, the third opening and the fourth opening have the same size, the third opening and the fourth opening being spaced a second distance apart, the second distance being different than the first distance.

10. The system of claim 9, wherein the second engagement mechanism is a pair of parallel extending prongs, the prongs being a third prong and a fourth prong, the third prong being substantially the same size as that of the fourth prong, the third prong and the forth prong being spaced a distance apart from one another that is the same as the second distance.

11. The system if claim 10, wherein one of the plurality of second barrel connectors is couple to the second end of the cord by plugging the third prong into the third opening and the forth prong into the fourth opening.

* * * * *